US012722198B2

(12) United States Patent
Rukat

(10) Patent No.: US 12,722,198 B2
(45) Date of Patent: Sep. 1, 2026

(54) RADIAL OFFSET MONITOR

(71) Applicant: CROWN PACKAGING TECHNOLOGY, INC., Alsip, IL (US)

(72) Inventor: Bronislaw Rukat, West Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 16/319,852

(22) PCT Filed: Jun. 13, 2017

(86) PCT No.: PCT/GB2017/051717
§ 371 (c)(1),
(2) Date: Jan. 23, 2019

(87) PCT Pub. No.: WO2018/020207
PCT Pub. Date: Feb. 1, 2018

(65) Prior Publication Data

US 2019/0240717 A1 Aug. 8, 2019

(30) Foreign Application Priority Data

Jul. 28, 2016 (GB) ..... 1613061

(51) Int. Cl.
*B21D 45/06* (2006.01)
*B21D 22/28* (2006.01)
*B21D 51/26* (2006.01)

(52) U.S. Cl.
CPC ..... *B21D 45/065* (2013.01); *B21D 22/286* (2013.01); *B21D 51/26* (2013.01)

(58) Field of Classification Search
CPC .... B21D 45/065; B21D 22/286; B21D 51/26; B21D 22/28; B21D 22/283; B21D 45/006;
(Continued)

(56) References Cited

U.S. PATENT DOCUMENTS 5,115,662 A 5/1992 Relich et al.
5,129,252 A * 7/1992 Hahn ..... B21D 22/28 72/349
(Continued)

FOREIGN PATENT DOCUMENTS

EP 2843359 A1 3/2015
GB 2141063 A * 12/1984 ..... B21D 22/286
(Continued)

*Primary Examiner* — Teresa M Ekiert
(74) *Attorney, Agent, or Firm* — Condo Roccia Koptiw LLP

(57) ABSTRACT

A stripper assembly for a can bodymaker is configured to remove a can body from a punch mounted on a ram of the can bodymaker. The stripper assembly comprises a stripper housing defining an internal bore through which the punch passes and a radial offset monitor. The radial offset monitor comprises one or more eddy current sensors located within the stripper housing or attached thereto. The radial offset monitor is configured to detect misalignment of a ram and/or a punch, or a can body held on the punch, within the bore. A method of detecting axial misalignment of a ram and/or a punch of a can bodymaker, or of a can body held on the punch is also described. The method comprises providing a stripper housing defining an internal bore through which the punch passes; obtaining electrical output signals from one or more eddy current sensors within the housing or attached thereto, and processing the signal(s) to detect any axial misalignment.

18 Claims, 14 Drawing Sheets

(58) Field of Classification Search
CPC ..... B21D 25/06; B21D 45/10; G01B 7/00; G01B 21/24; B30B 15/007
USPC ..... 73/345
See application file for complete search history.

(56) References Cited

U.S. PATENT DOCUMENTS

| | | | | |
|---|---|---|---|---|
| 5,257,523 | A * | 11/1993 | Hahn | F16C 32/0444 72/349 |
| 7,568,369 | B2 * | 8/2009 | Kubacki | B21D 51/26 72/58 |
| 8,356,508 | B2 * | 1/2013 | Davies | B21D 22/30 413/69 |
| 8,910,531 | B1 * | 12/2014 | Sue | F01D 21/003 73/862.08 |
| 2003/0070516 | A1 * | 4/2003 | Harada | B21D 45/006 83/13 |
| 2008/0217823 | A1 * | 9/2008 | Kubacki | B21D 51/26 264/524 |
| 2015/0000361 | A1 | 1/2015 | Fleischer et al. | |
| 2015/0314548 | A1 * | 11/2015 | Schwelling | B30B 15/007 100/46 |
| 2016/0245343 | A1 | 8/2016 | Munk | |

FOREIGN PATENT DOCUMENTS

| | | | |
|---|---|---|---|
| JP | S5899706 | A | 6/1983 |
| JP | 2003-094117 | A | 4/2003 |
| JP | 2009-190093 | A | 8/2009 |
| JP | 2014-237175 | A | 12/2014 |
| WO | 92/04142 | A1 | 3/1992 |
| WO | WO 99/34942 | A1 | 7/1999 |
| WO | 00/45975 | A1 | 8/2000 |

* cited by examiner

RADIAL OFFSET MONITOR

CROSS-REFERENCE TO RELATED APPLICATIONS

This application is the National Stage of International Application No. PCT/GB2017/051717 filed Jun. 13, 2017, which claims the benefit of GB application number 1613061.9, filed Jul. 28, 2016, the disclosures of which are incorporated herein by reference in their entirety.

TECHNICAL FIELD

The present invention relates to a radial offset monitor, and in particular, though not necessarily, to a can bodymaker comprising a radial offset monitor. The invention also relates to a method of detecting a radial offset of a bodymaker ram and/or punch.

BACKGROUND

In known bodymakers for the production of thin-walled metal can bodies by a "drawing and wall-ironing" (DWI) process, metal cups are fed to the bodymaker and carried by a punch on the end of a ram through a series of dies to produce a can body of the desired size and thickness. The series of dies may include a redraw die for reducing the diameter of the cup and lengthening its sidewall, and one or more ironing dies for wall-ironing the cup into a can body. The area or cradle of the bodymaker frame within which the dies are located is known as the "toolpack". The can body carried on the punch may ultimately contact a bottom forming tool or "domer" so as to form a shape such as a dome on the base of the can. An exemplary bodymaker is described in WO9934942.

When setting up a can bodymaker, the ram and its drive components are typically fixed in place on the bodymaker frame. This aligns the axis of the ram with the main axis of the bodymaker. The other components, including for example the redraw and ironing dies and domer, are then aligned with the ram.

Over time, frictional forces and general wear will cause the alignment of the ram to vary slightly. In addition, a high speed reciprocating ram is generally subject to at least some vibration, due to the impact of the ram on the can body and to the variable "droop" of the ram as it moves from and to its fully-extended position. When the ram carries the can body into contact with the domer, any misalignment can lead to the can body end splitting, particularly where the can body is aluminium. If the misalignment is slight, the split (sometimes known as a "smile") may not be immediately visible to the naked eye, and the split may lead to the can bursting once the can body has been filled. This may not occur until the filled can has been purchased.

Alignment procedures for known bodymakers are complex and require significant skill to ensure that the machines can be operated safely and efficiently. A typical method of aligning the ram of a bodymaker comprises halting the production line and inserting two gauge rings comprising sensors into the bodymaker toolpack, preferably in the positions usually occupied by the first and third ironing dies. The gauges must be inserted in the correct orientation and must then be calibrated. Measurements may then be taken as the punch passes through the gauge ring on the forward stroke, backward stroke and during and after doming. This process is carried out in the absence of a can body to avoid the sensors detecting the can body rather than the punch.

Alignment and re-alignment of known bodymakers is therefore a time consuming process which requires the can body production line to be halted. The high volume nature of the can industry means that lost production time can be very costly for producers.

SUMMARY OF THE INVENTION

According to a first aspect there is provided a stripper assembly for a can bodymaker and being configured to remove a can body from a punch mounted on a ram of the can bodymaker. The stripper assembly comprises a stripper housing defining an internal bore through which the punch passes and a radial offset monitor comprising one or more eddy current sensors, the one or more eddy current sensors being located within the housing or attached thereto. The radial offset monitor is configured to detect misalignment of the ram and/or the punch, or of a can body held on the punch, within the bore.

The radial offset monitor may be integrated into the stripper housing or may be co-located with the stripper housing, wherein the sensor housing defines an internal bore and the or each eddy current sensor is located within the sensor housing. The stripper assembly may comprise a stripper provided with stripping fingers. The stripper assembly may comprise at least two eddy current sensors angularly spaced apart from one another about an axis along which the punch travels. The radial offset monitor may comprise four eddy current sensors equiangularly spaced apart from one another about the axis. The or each eddy current sensor may be adjustable in a direction orthogonal to an axis along which the punch travels. Said bore may be cylindrical.

According to a second aspect there is provided a can bodymaker comprising a ram; a punch mounted on the ram; a toolpack; and a stripper assembly according to the first aspect above.

The can bodymaker may comprise a controller having an input for receiving sensor data from the radial offset monitor; and a processor configured to compute one or more of ram position, ram trajectory, punch position, punch trajectory, can body presence, and can body sidewall thickness.

The can bodymaker may comprise an adjustment mechanism to automatically adjust one or more components of the bodymaker in response to detection by the radial offset monitor of a misalignment of the ram and/or punch and/or can body in order to achieve realignment. The one or more components may be or may include the ram, the punch, a domer, and the adjustment may be a radial adjustment.

According to a third aspect there is provided a can bodymaker comprising a radial offset monitor, said radial offset monitor comprising a body defining an internal bore and one or more eddy current sensors spaced around the bore and configured to detect the misalignment of an object moving axially through the bore, relative to the axis, wherein said object is a ram and/or a punch, or a can body held on the punch, of the can bodymaker.

According to a fourth aspect there is provided a method of detecting axial misalignment of a ram and/or a punch of a can bodymaker, or of a can body held on the punch. The method comprises providing a stripper housing defining an internal bore through which the punch passes; obtaining electrical output signals from one or more eddy current sensors within the housing or attached thereto; and processing the signal(s) to detect any axial misalignment.

The method may comprise processing the sensor data to compute one or more of ram position, ram trajectory, punch position, punch trajectory, can body presence, can body sidewall thickness. The method may comprise using an adjustment mechanism to automatically adjust one or more components of the bodymaker in order to correct the misalignment. The method may be carried out while the bodymaker is producing can bodies.

In an embodiment, a can bodymaker comprises a ram; a punch fixed to an end of the ram; a toolpack; a stripper comprising a stripper housing; and a radial offset monitor comprising a body defining an internal bore and one or more eddy current sensors spaced around the bore, the body of the radial offset monitor co-located with, or integrated into, the stripper housing. The radial offset monitor is configured to detect the misalignment of the ram and/or the punch, or of a can body held on the punch, moving axially through the bore, relative to the axis.

In another embodiment, a method of detecting axial misalignment of a ram and/or a punch of a can bodymaker, or of a can body held on the punch, comprises obtaining electrical output signals from one or more eddy current sensors spaced around a bore extending through a body within which the sensor(s) is(are) located, as the ram and/or the punch, or the can body held on the punch moves through the bore, wherein said body is co-located with or integrated into a stripper housing; and processing the signal(s) to detect any axial misalignment.

In a further embodiment, a radial offset monitor comprises a body defining an internal bore and one or more eddy current sensors spaced around the bore. The radial offset monitor may be configured to detect the misalignment of an object moving axially through the bore, relative to the axis. The radial offset monitor may be configured to be attached to a toolpack module of a can bodymaker, and said object may be a ram and/or a punch, or a can body held on the punch.

In a still further embodiment, a can bodymaker comprises the above radial offset monitor, and the object is a ram and/or a punch, or a can body held on the punch, of the can bodymaker. The body of the radial offset monitor is co-located with, or integrated into, a stripper housing.

DETAILED DESCRIPTION

Figure 1:
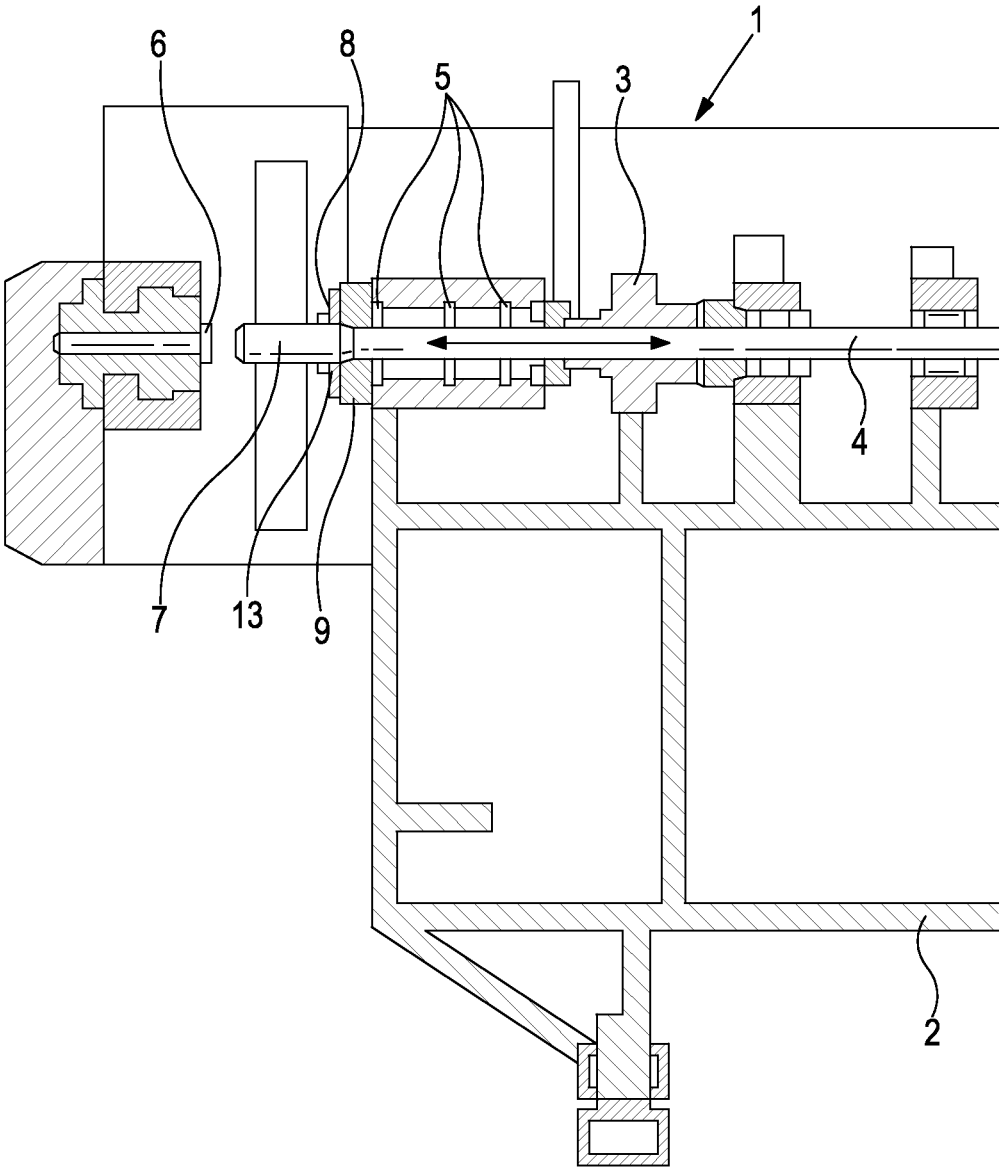
Figure 1 Prior Art
FIG. 1 illustrates schematically a cross-section of a part of a known bodymaker.

FIG. 1 illustrates schematically a cross-section of a known long-stroke bodymaker 1. The bodymaker 1 comprises a frame 2 and a ram 4 supported by a pair of hydrostatic bearings (not shown). The ram 4 is constructed using a metal or metal alloy and moves horizontally through a series of ironing dies 5. The dies 5 are clamped to a large block of metal or bolster plate 9. On the forward stroke, the ram 4 moves towards a bottom forming tool or domer 6 and on the return stroke the ram 4 moves away from the domer 6. A punch 7 is mounted on the end of the ram 4 nearest the domer 6. The punch 7 is constructed using a metal or metal alloy, such as steel. At the furthest extent of the ram's 4 forward stroke, a base of a can body (not shown) held on the end of the punch 7 is brought into contact with the domer 6. At the furthest extent of the ram's 4 backward stroke, the punch 7 will be located at a position to the right of a blankholder 3 of the bodymaker 1. In one complete cycle the ram 4 therefore moves from the blankholder 3 to the domer 6 and back again.

Metal cups are fed into the bodymaker 1 one at a time to the left of the blankholder 3 position. Each cup is carried by the punch 7 through the series of dies 5 as described above, as the ram 4 moves forwards. At the end of the forward stroke the resulting can body is brought into contact with the domer 6 and the base of the can body is formed. As the ram 4 begins its return stroke, the can body is removed from the punch 7 by a stripper 8 forming part of a stripper assembly. The stripper 8 may comprise a plastic or a steel ring. The stripper 8 in this example consists of stripping fingers (not shown here) mounted within an annular plastic stripper housing 13, located at one end of the die assembly 5. The radially inward ends of the stripping fingers extend into the bore of the die assembly 5 through which the punch 7 passes. On the forward stroke of the ram 4 the can body carried on the punch 7 deflects the stripping fingers as it moves along the bore of the die assembly 5. As the punch 7 moves on the return stroke, i.e. away from the domer 6, the stripping fingers prevent the can body from returning with the punch 7 and the can body is stripped from the punch 7 and then removed from the bodymaker 1. In other embodiments not shown here, the can body may be removed from the bodymaker 1 by pressurised air (alternatively, pressurised air may be used to assist removal by a stripper).

FIGS. 2, 3, 4 and 5 illustrate a first embodiment of a radial offset monitor or ram position sensor 10 comprising a plurality of sensors 11 housed within the outer circumference of a stripper housing 13 which is part of a stripper assembly and which takes the form of an annular ring defining an internal bore through which the punch 7 of the bodymaker passes. In FIG. 2*a*, the stripper housing 13 is illustrated from the rear, i.e. as seen from the toolpack of the bodymaker, and without the stripper being present. In this example, there are four sensors 11 equally spaced around the stripper housing 13, although fewer, or additional sensors, may be used. For example, two or three sensors may be used, and these may be equally or unequally circumferentially spaced apart from one another about an axis along which the punch of the bodymaker travels. The stripper housing 13 may be a monolithic block machined from a single piece of metal, and comprises an internal bore configured to accommodate a can body of specific diameter, located on the punch 7.

The sensors 11 are eddy current sensors, such as the eddyNCDT™ range manufactured by Micro-Epsilon™. Unlike simple inductive sensors, eddy current sensors provide the ability to measure distances to conductive objects with an extremely high degree of precision (in the nanometre range). Advantageously, no contact with the object is required, such that measurement is wear-free.

The eddy current sensors 11 each comprise a coil (not shown here) inside an outer casing. The coil is supplied with a high-frequency alternating current in order to produce an electromagnetic field. The coil's electromagnetic field induces eddy currents in the conductive object. These eddy currents create an opposing magnetic field which resists the field produced by the coil. The interaction of magnetic fields produced by the coil and the conductive object depends upon the distance between them, and changes when the distance changes. The sensors 11 then produce a voltage output proportional to the change in distance between the conductive object and the sensor 11.

The electromagnetic field produced by a sensor 11 is capable of penetrating non-metallic objects. This means that eddy current sensors 11 can be used to produce measurements even where the (metallic) object has a non-conductive coating, such as plastic, or where the metallic object is contaminated with dirt or oil. The sensors 11 are also substantially insensitive to temperature change.

Figure 2A:
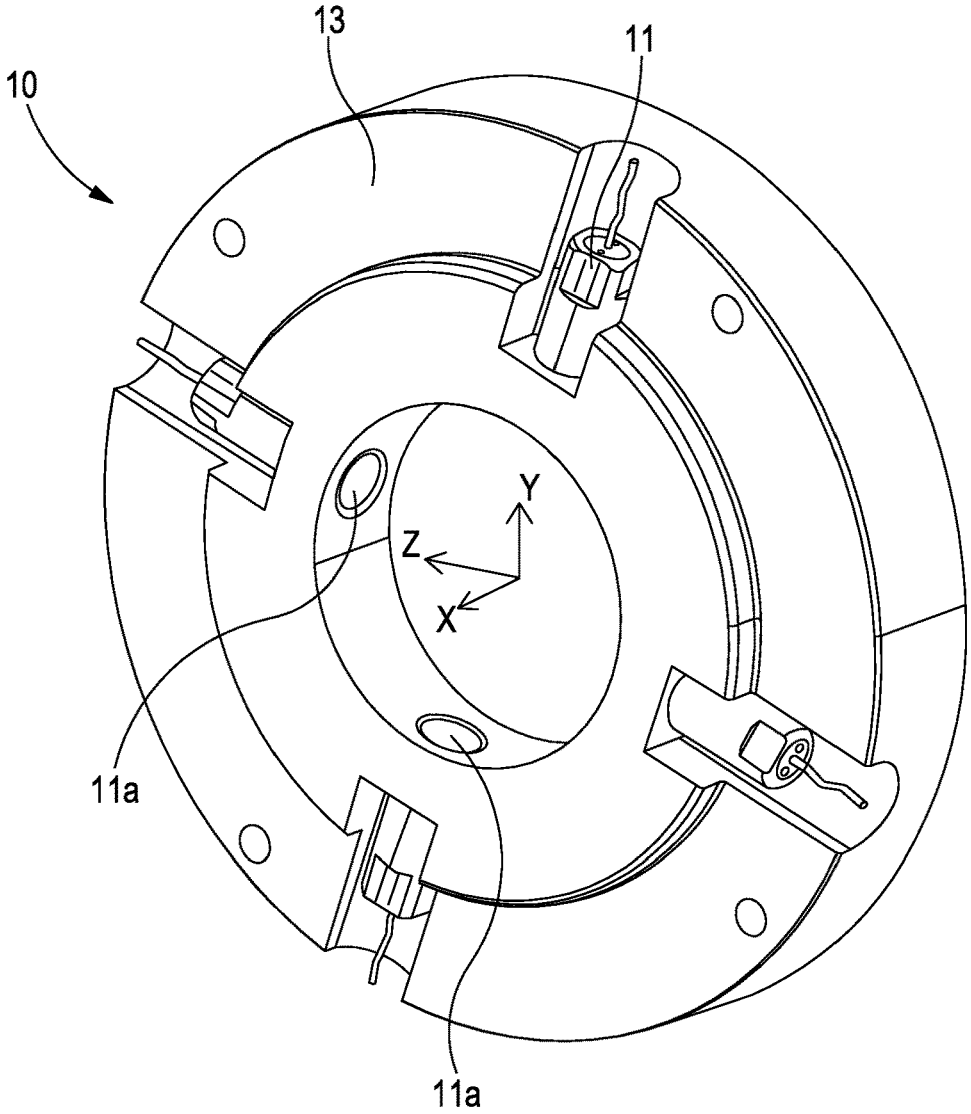
FIG. 2*a* is a perspective view of a plurality of sensors integrated into a stripper housing.
Figure 2B:
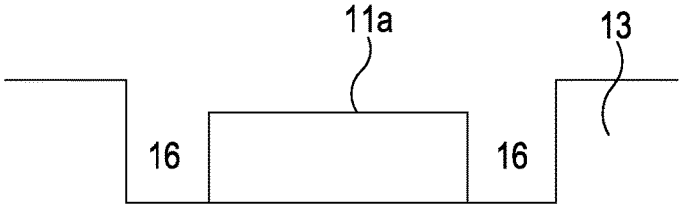
FIG. 2*b* is a cross-sectional schematic view of a sensor within the stripper housing.

Each sensor 11 comprises a face 11*a* which is located within a circumference of the internal bore of the stripper housing 13 and which faces into the internal bore of the stripper housing 13. As illustrated in FIG. 2*b*, each sensor 11 is housed within the stripper housing 13 such that the face 11*a* of the sensor 11 does not protrude from the stripper housing 13. The face 11*a* may be flush with an exterior of the housing 13, or the face 11*a* may be slightly recessed, as shown in FIG. 2*b*. An air gap 16 is provided around the sensor face 11*a*, such that the sensor face 11*a* does not come into contact with the stripper housing 13. This avoids any interference from the stripper housing 13, which may be constructed from plastic or from metal.

Figure 3:
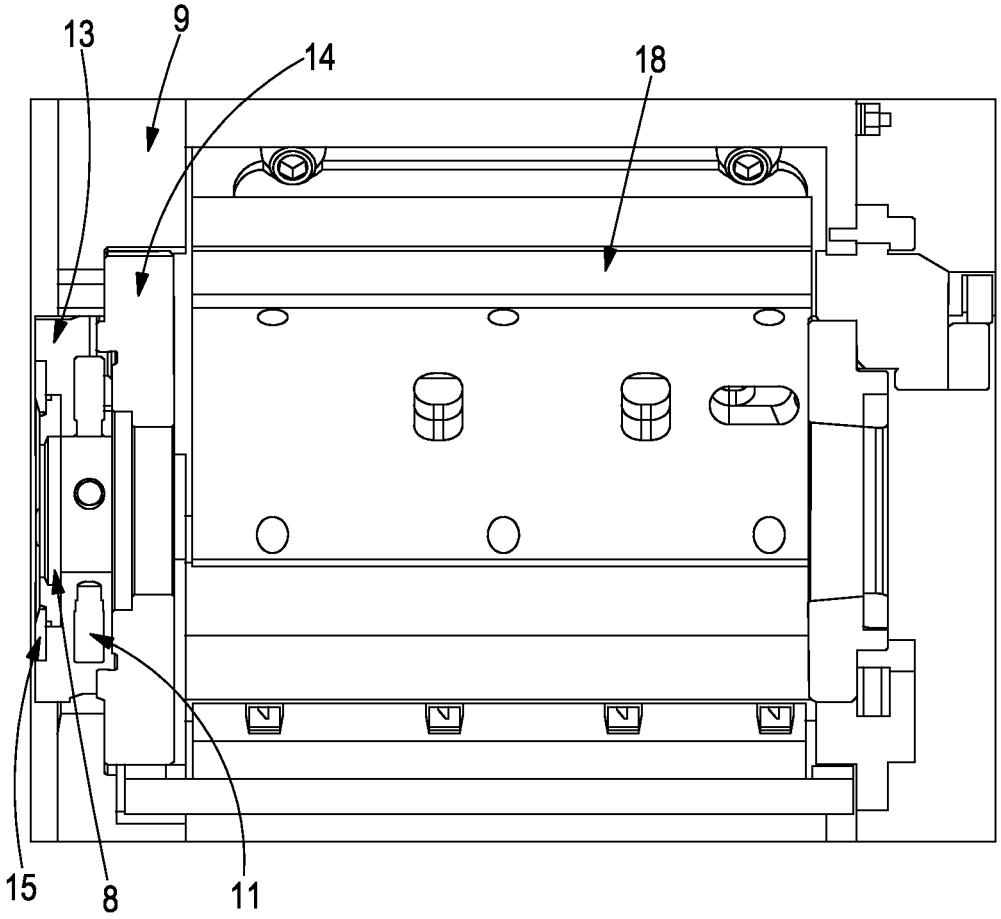
FIG. 3 is a cross-sectional view of the stripper housing of FIG. 2 in position on a bodymaker.
Figure 4:
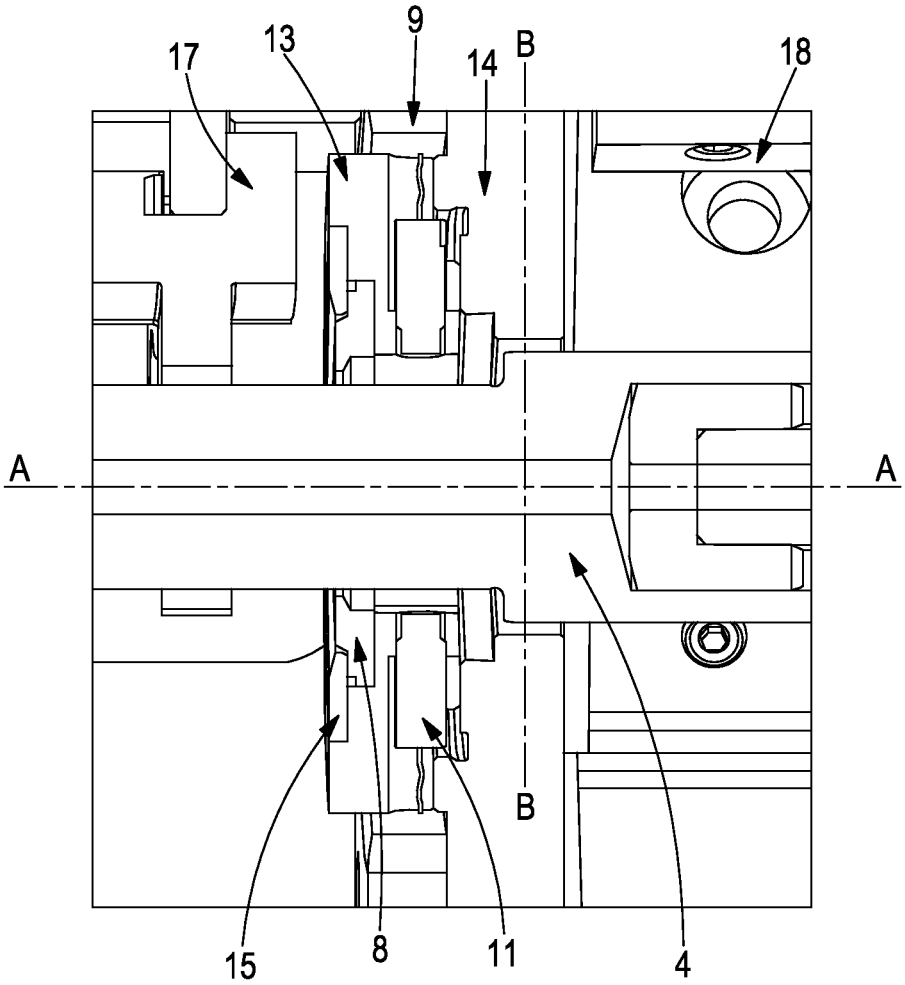
FIG. 4 is an enlarged cross-sectional view of the bodymaker of FIG. 3.
Figures 5A, 5B:
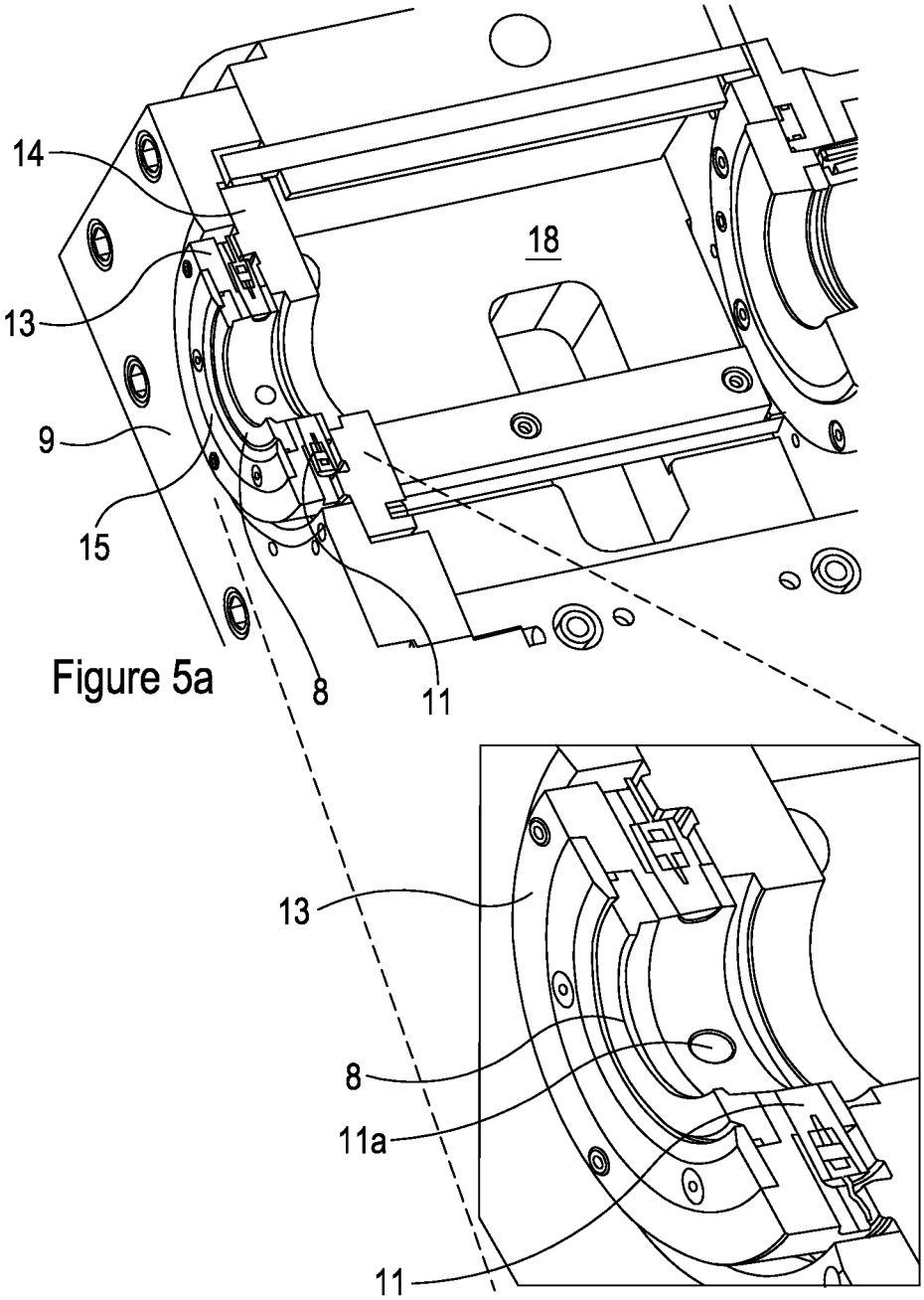
FIG. 5*a* is a perspective cross-sectional view of the bodymaker of FIG. 3.
FIG. 5*b* is an enlarged section of the view of FIG. 5*a;*

FIGS. 3, 4 and 5 illustrate the stripper housing 13 and integrated sensors 11 of FIG. 2 positioned within a bodymaker, such as the bodymaker of FIG. 1. In these illustrated examples, a section of the bodymaker comprising the stripper 8, stripper housing 13, sensors 11 and bolster plate 9 is shown. This illustrated section of the bodymaker further comprises an adapter plate 14 and a retaining ring 15. The adaptor plate 14 enables the stripper 8 and stripper housing 13 to be attached to the bodymaker 1 and the retaining ring 15 holds the stripper 8 in place on the front of the stripper housing 13. In this illustrated example, the toolpack, identified by reference numeral 18, is shown without tools (i.e. the die assembly is not shown).

An advantage of integrating the sensors 11 into an interior of the stripper housing 13 is that no additional space is required between the adapter plate 14 and the retaining ring 15. Both the sensors 11 and stripper housing 13 may be accommodated within the space usually occupied by the stripper housing 13 alone, hence the overall longitudinal dimensions of the bodymaker 1 are unaffected by the inclusion of the sensors 11.

FIG. 4 illustrates the ram 4 on its forward stroke, passing through the internal bore of the stripper housing 13. Also illustrated is the can body unloader pocket 17, which forms part of the discharge turret and which transports the manufactured can body (not shown) away from the bodymaker.

The eddy current sensors 11 continuously sense or monitor the position or radial offset of the ram 4 (i.e. measure the distance between themselves and the ram surface) as it passes through the stripper housing 13 and send this information to a bodymaker controller (not shown), comprising a PLC (programmable logic circuit). The sensors 11 and the controller may be in wired or in wireless communication. The controller calculates the distance of the ram 4 from a longitudinal bodymaker axis, indicated in FIG. 4 by line AA. The alignment of the ram may also be measured with respect to a vertical bodymaker axis indicated in FIG. 4 by line BB. The information provided by the sensors is displayed on an external device (not shown here) comprising a display screen, as will be further discussed below.

It will be appreciated that a bodymaker may need to be re-configured to produce can bodies of different diameters, by replacing the toolpack with a toolpack having dies of a different diameter and by replacing the ram with a ram having a different diameter. For example, to accommodate a larger can body, a ram having a 2 inch diameter might be replaced by a ram having a 3 inch diameter. In this case, the stripper will also need to be replaced in order to accommodate the ram and to remove the can body.

Figure 6A:
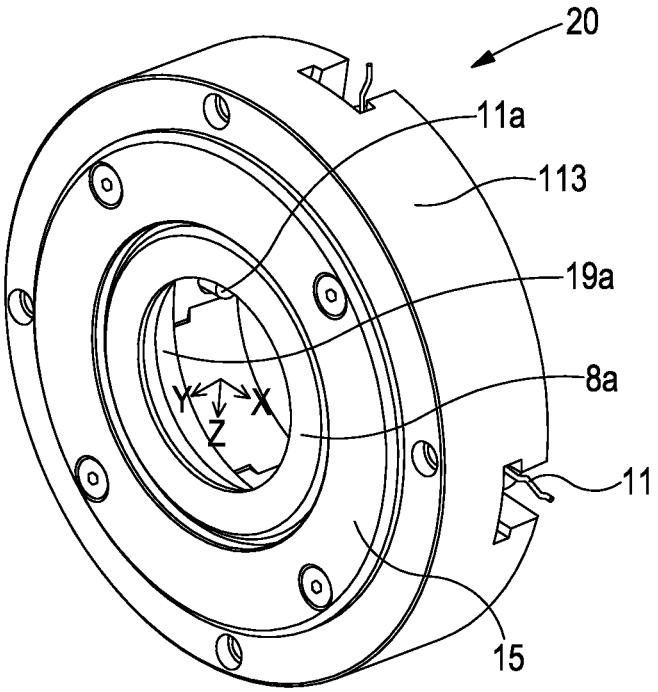
FIG. 6*a* is a perspective view of a stripper housing comprising adjustable sensors and attached to a plastic stripper.
Figure 6B:
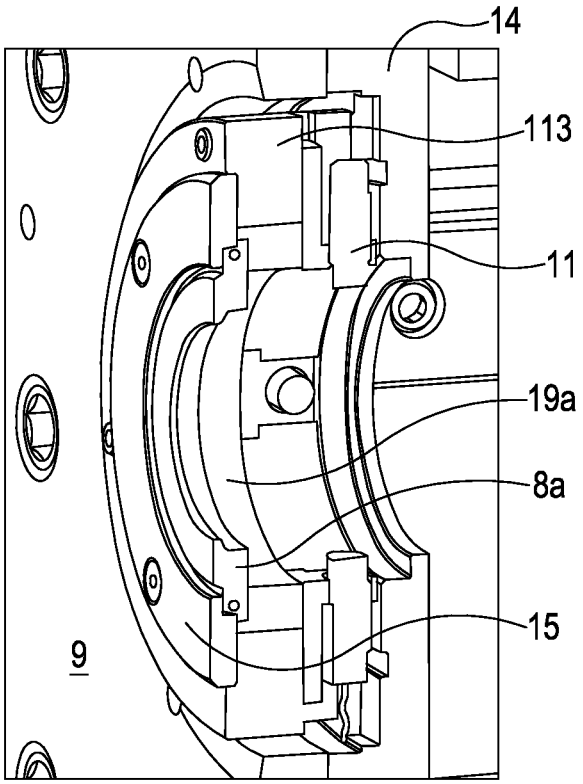
FIG. 6*b* is a perspective view of the stripper housing of FIG. 6*a* in position on a bodymaker.
Figure 7A:
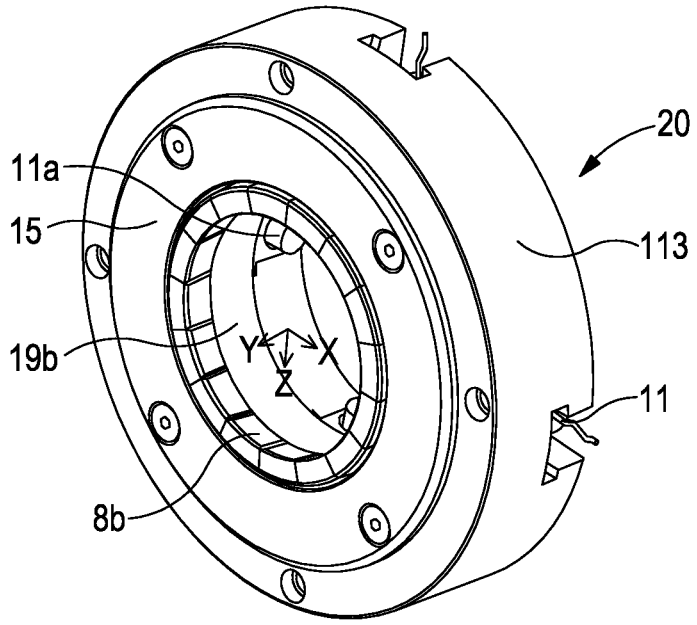
FIG. 7*a* is a perspective view of a stripper housing comprising adjustable sensors and attached to a steel stripper.
Figure 7B:
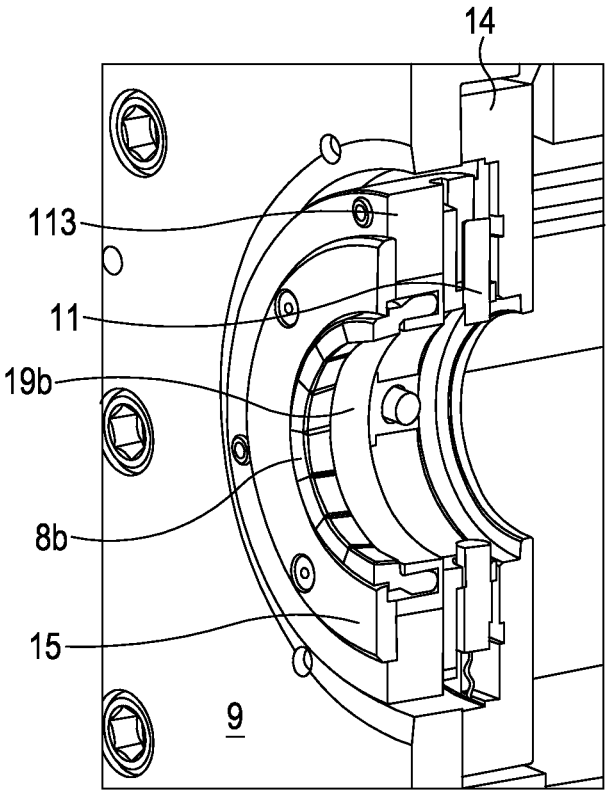
FIG. 7*b* is a cross-sectional view of the stripper housing of FIG. 7*a* in position on a bodymaker.
Figure 8:
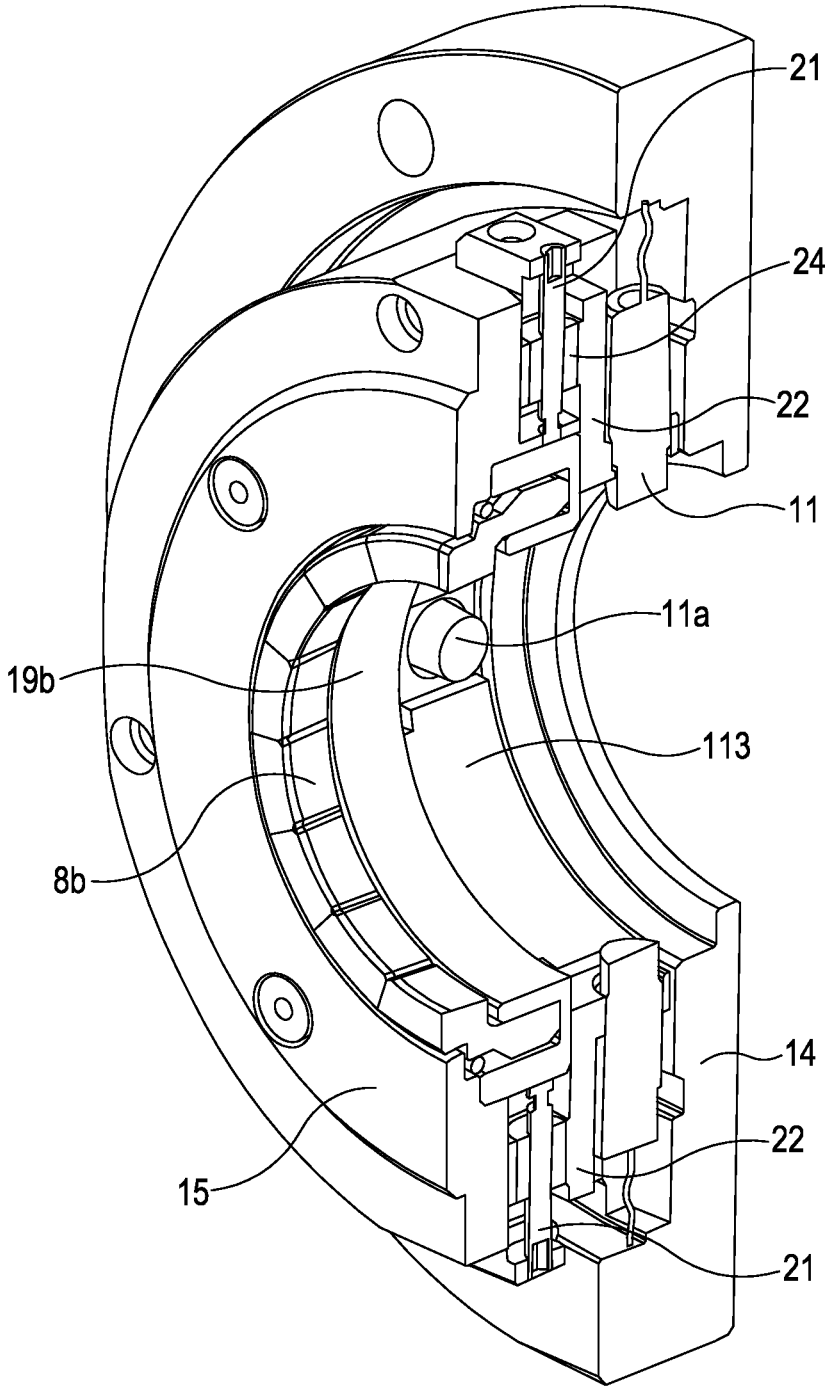
FIG. 8 is a cross-sectional view of the stripper housing of FIG. 7*a;*

FIGS. 6, 7 and 8 illustrate a second embodiment of radial offset monitor 20, in which the eddy current sensors 11 integrated into a stripper housing 113 are adjustable. FIGS. 6*a* and 6*b* illustrate a plastic stripper 8*a* attached to the stripper housing 113 by a retaining ring 15. FIGS. 7*a*, 7*b* and 8 illustrate the same stripper housing 113, to which a steel stripper comprising steel fingers 8*b* is attached using the retaining ring 15. The plastic stripper 8*a* has a smaller internal bore than the steel stripper 8*b*, hence the steel stripper 8*b* can accommodate a ram, and a can body, of larger diameter. The stripper housing 113 has an internal bore configured to accommodate the largest diameter ram to be used with the bodymaker. In order to facilitate the exchange of strippers 8*a*, 8*b*, each stripper 8*a*, 8*b* is provided with a stripper adapter ring 19*a*, 19*b*. When changing from one type of stripper to another, only the stripper 8*a*, 8*b* and the stripper adapter ring 19*a*, 19*b* need be replaced.

In both FIGS. 6 and 7, eddy current sensors 11 which are configured to be adjustable are integrated into the stripper housing 113, as will be discussed in more detail below. In these examples, four eddy current sensors 11 are equally spaced around the stripper housing 113, with sensor faces 11*a* facing into the bore of the stripper housing 113. However, fewer or additional sensors may be used. For example, two or three sensors may be used, and these may be equally or unequally spaced around the stripper housing. An air gap (not shown here) is provided around each sensor face 11*a*, such that the sensor face 11*a* does not come into contact with the stripper housing 113.

FIG. 8 is a perspective cross-sectional view of the stripper housing 113 of FIG. 7, shown attached to an adaptor plate 14. The steel stripper 8*b* is held in place on the stripper housing 113 by a retaining ring 15 and is provided with a stripper adapter ring 19*b*. Although a steel stripper 8*b* is shown in this example, the plastic stripper 8*a*, or an alternative stripper, could also be used.

The stripper housing 113 is configured to accommodate four adjustment mechanisms, one adjacent to each eddy current sensor 11. For example, the stripper housing 113 may comprise cut outs of a suitable size and shape. In this example, each adjustment mechanism comprises a miniature high precision ball screw 21 and a guide mechanism 22. The ball screw 21 converts rotary motion to linear motion. Each screw 21 comprises a moveable collar 24 attached to the guide mechanism 22, which is in turn attached to the adjacent eddy current sensor 11.

Upon manual or automatic adjustment of the ball screw 21, the collar 24, guide mechanism 22 and hence the eddy current sensor 11 can be adjusted in a direction orthogonal to the inner face of the stripper housing 113. In other words, the eddy current sensor 11 can be adjusted, or screwed in or out, so that the face of the sensor 11*a* either protrudes from, is flush with or is recessed into the inner face of the stripper housing 113. It will be appreciated that the position of the sensor face 11*a* can be adjusted depending upon the diameter of the ram which is to be used. Sensor recalibration may be required after adjustment.

The adjustability of the sensors 11 allows the same stripper housing 113 to be used with a range of ram sizes. The ball screws 21 can be adjusted without removing the stripper housing 113 and so the sensors 11 can be easily and quickly configured to be used with a variety of ram sizes.

Figure 9:
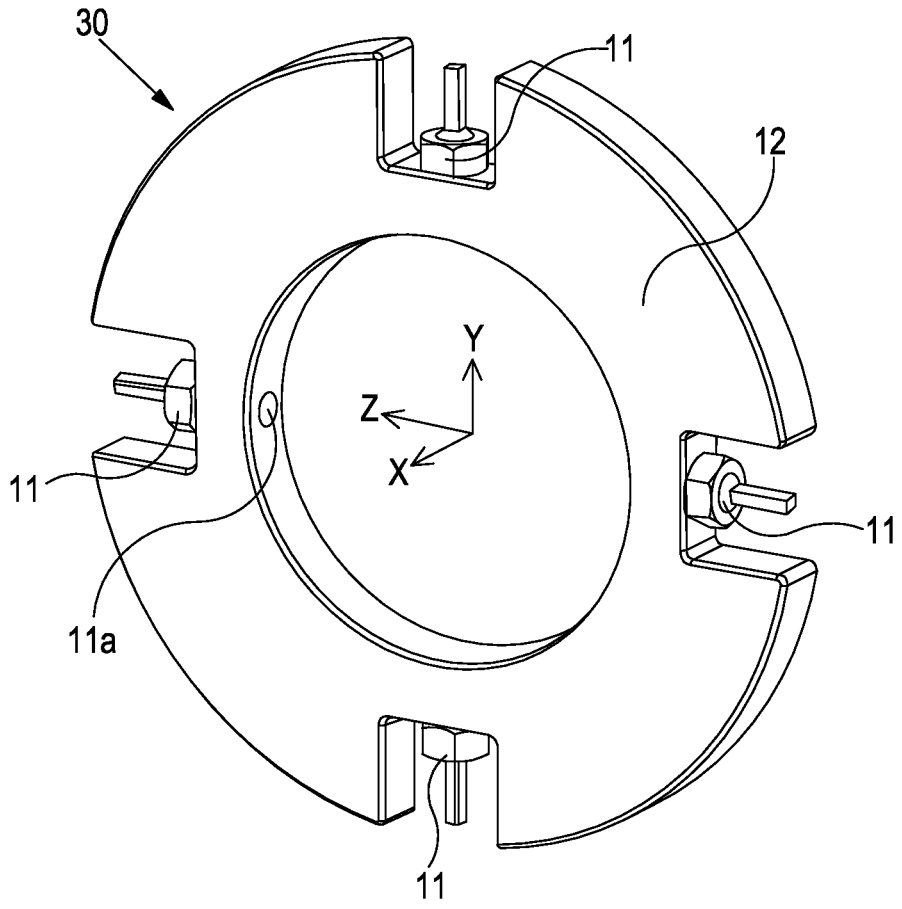
FIG. 9 is a perspective view of a plurality of sensors integrated into a sensor housing.
Figure 10:
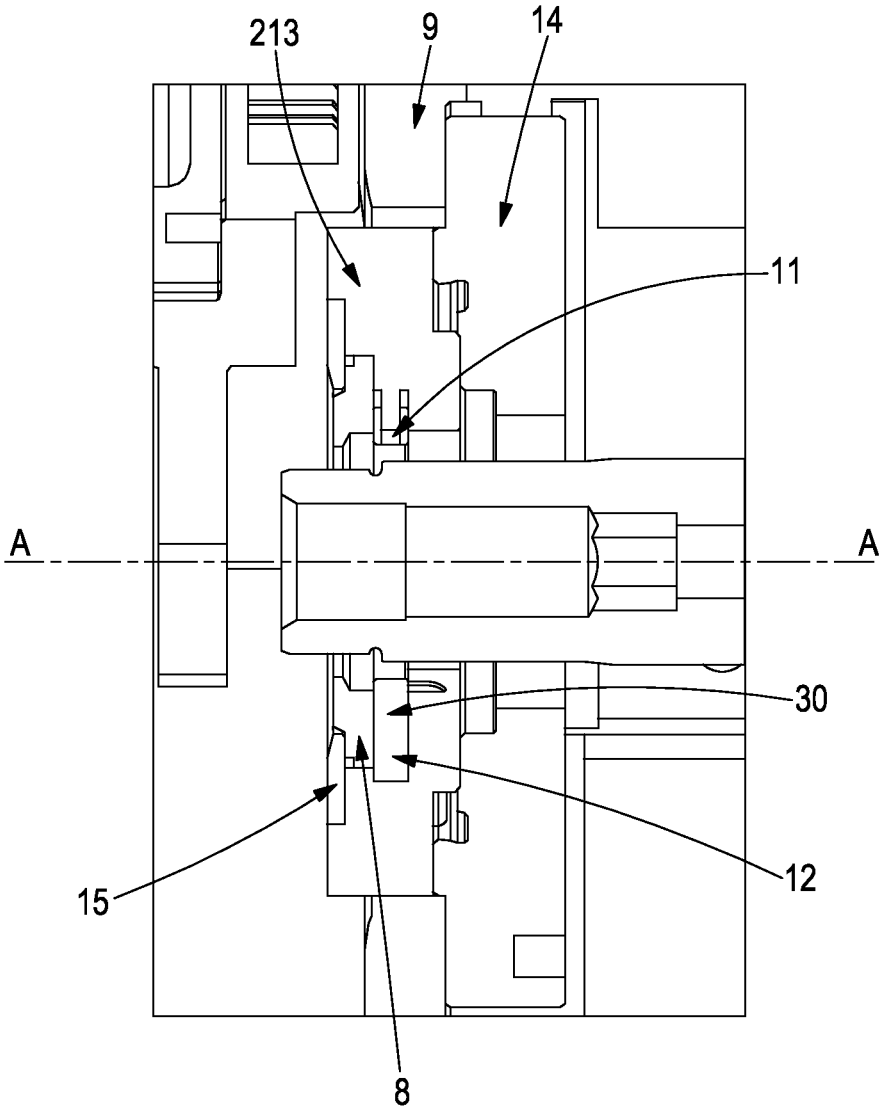
FIG. 10 is a cross-sectional view of the sensor housing of FIG. 9 in position on a bodymaker.
Figures 11A, 11B:
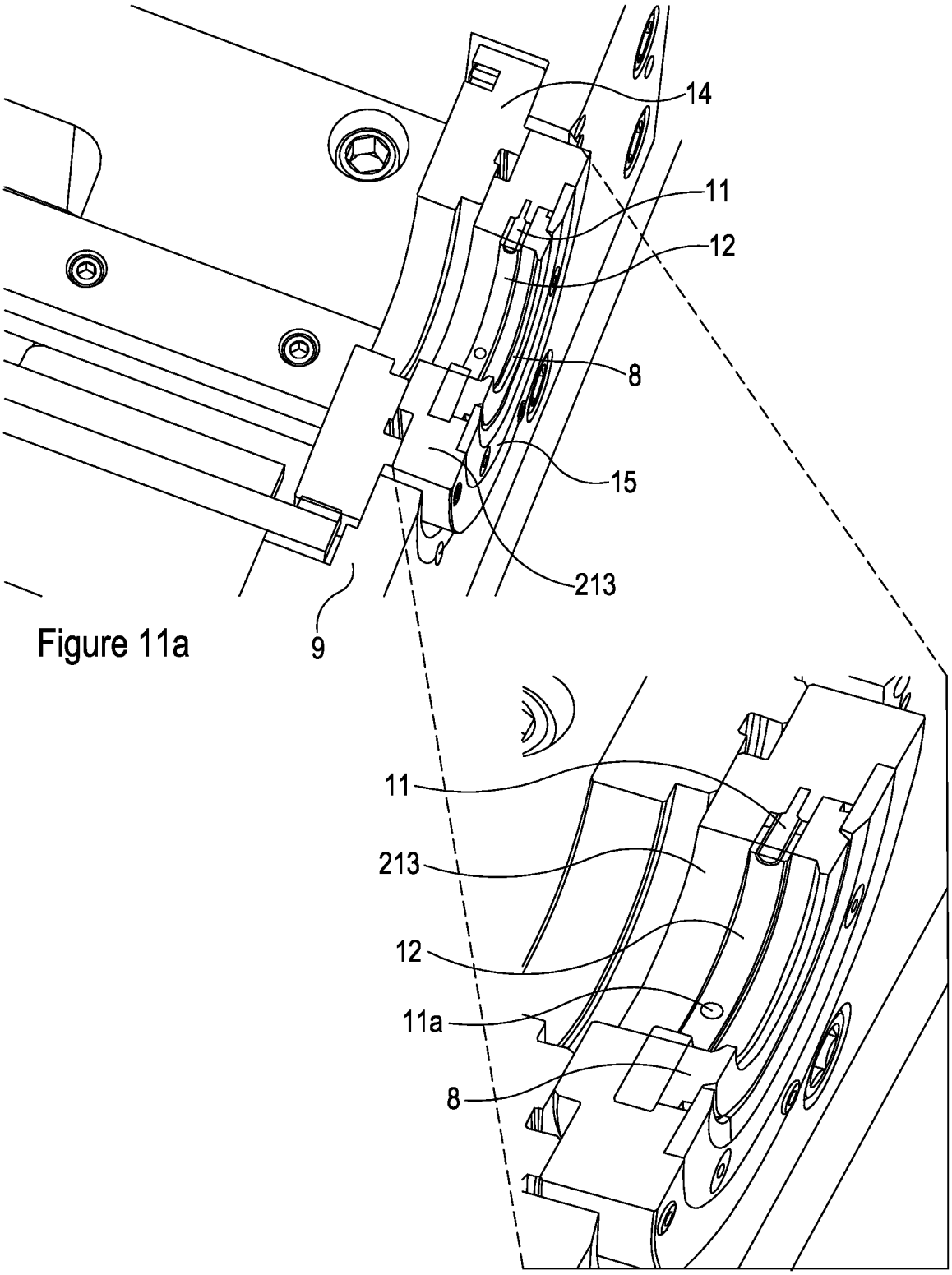
FIG. 11*a* is a perspective cross-sectional view of the bodymaker of FIG. 10.
FIG. 11*b* is an enlarged section of the view of FIG. 11*a;*

A third embodiment of a radial offset monitor or ram position sensing gauge 30 is illustrated in FIGS. 9, 10 and 11. In this embodiment, a number of eddy current sensors 11 are housed in a separate sensor housing 12, attached to the stripper housing 213. In other words, the separate sensor housing 12 is co-located with the stripper housing 213, both forming part of the stripper assembly. In this illustrated example, there are four eddy current sensors 11 equally spaced around the annular sensor housing 12, although fewer, or additional sensors, may be used. For example, two or three sensors may be used and these may be equally or unequally angularly spaced around the sensor housing. The housing 12 defines an internal bore through which the punch 7 of the bodymaker passes, and configured to accommodate a can body located on the punch 7.

In use, the sensor housing 12 is located between a stripper housing 213 and the stripper 8, as will be discussed further below. The face 11*a* of each sensor 11 is located within a circumference of an internal bore of the sensor housing 12, such that the face 11*a* of the sensor 11 does not protrude from the sensor housing 12. As discussed with reference to FIG. 2*b* above, each sensor face 11*a* is surrounded with an air gap to avoid any interference from the sensor housing 12.

FIGS. 10 and 11 illustrate the sensor housing 12 of FIG. 9 in position within a bodymaker, such as the bodymaker of FIG. 1, shown with the toolpack removed. In this illustrated example, the sensors 11 are not integrated into the stripper housing 213, but are instead mounted equiangularly around a separate sensor housing 12, located behind the stripper 8, i.e. between the stripper 8 and stripper housing 213. In this case, the stripper housing 213 is adapted with one or more recesses to provide space for the sensor housing 12.

The embodiments described above may be retrofitted to existing bodymakers. Advantageously, the embodiment of FIGS. 9, 10 and 11, in which a separate sensor housing 12 is provided, can be moved from one bodymaker to another in order to carry out diagnostic testing on the alignment of the ram 4. In other words, the sensor housing 12 may be removed from its position between the stripper 8 and the stripper housing 213 without affecting the configuration or the operation of the bodymaker. Similarly, the sensor housing 12 may be re-fitted into the bodymaker where further diagnostic testing is required. The number of radial offset monitors required is therefore reduced.

The eddy current sensors 11 provide precise, real-time information as to the ram 4 position with respect to the bodymaker 1 axis or axes. Since the punch 7 is located on a distal end of the ram 4, the sensors 11 can also provide information regarding the position of the punch 7. Positional information can be provided by the sensors 11 both when the ram 4 is stationary and when the bodymaker 1 is running, i.e. when the bodymaker is in normal operation and can bodies are being fed in. Since the radial offset monitor 10, 20, 30 either comprises a stripper housing 13, 113 or is mounted between the stripper housing 213 and the stripper 8, it is not necessary to remove any of the dies 5.

In addition to dynamically monitoring the radial offset of the ram 4 with respect to an axis of the bodymaker, the sensors 11 can also provide information regarding the ram's 4 trajectory i.e. the path the ram 4 will take after it passes through the stripper housing 13, 113, 213 and/or the sensor housing 12. This can be provided by taking a series of measurements of the ram's position as it passes by the sensors 11.

The sensor data received can also be used to monitor the punch 7 trajectory and alignment, as well as measuring ram 4 vibration. The use of highly sensitive eddy current sensors 11 also means that it is possible to detect whether a can body is present on the punch 7 or not, and to measure a thickness of the can body. Since the sensitivity of the eddy current sensors eliminates interference from the can body, these measurements can be taken while the bodymaker 1 is idle and also when the bodymaker 1 is making can bodies.

Detection of the presence and/or thickness of a can body on the punch 7 is useful as it can indicate whether a can body has been properly removed from the punch 7 by the stripper 8, and whether there are any defects in the can body, e.g. the sidewall of the can body is too thin or too thick, potentially indicating cracks or splits.

The signal from the sensors 11 is sent to the bodymaker controller where it is converted and presented on a human-machine interface (HMI), which may comprise a screen or digital display. The signal can be presented in several different ways. For example, the processed signal output may show the position of the punch 7 in relation to its fully-aligned target position; the position of the ram/punch in relation to the A and/or B axis of the bodymaker; the trajectory of the ram/punch as a 3D plot; a 3D ram/punch patch plot or A-B axis ram/punch patch plot; a plot of the position of the ram or punch in relation to an axis of the bodymaker 1.

Figure 12:
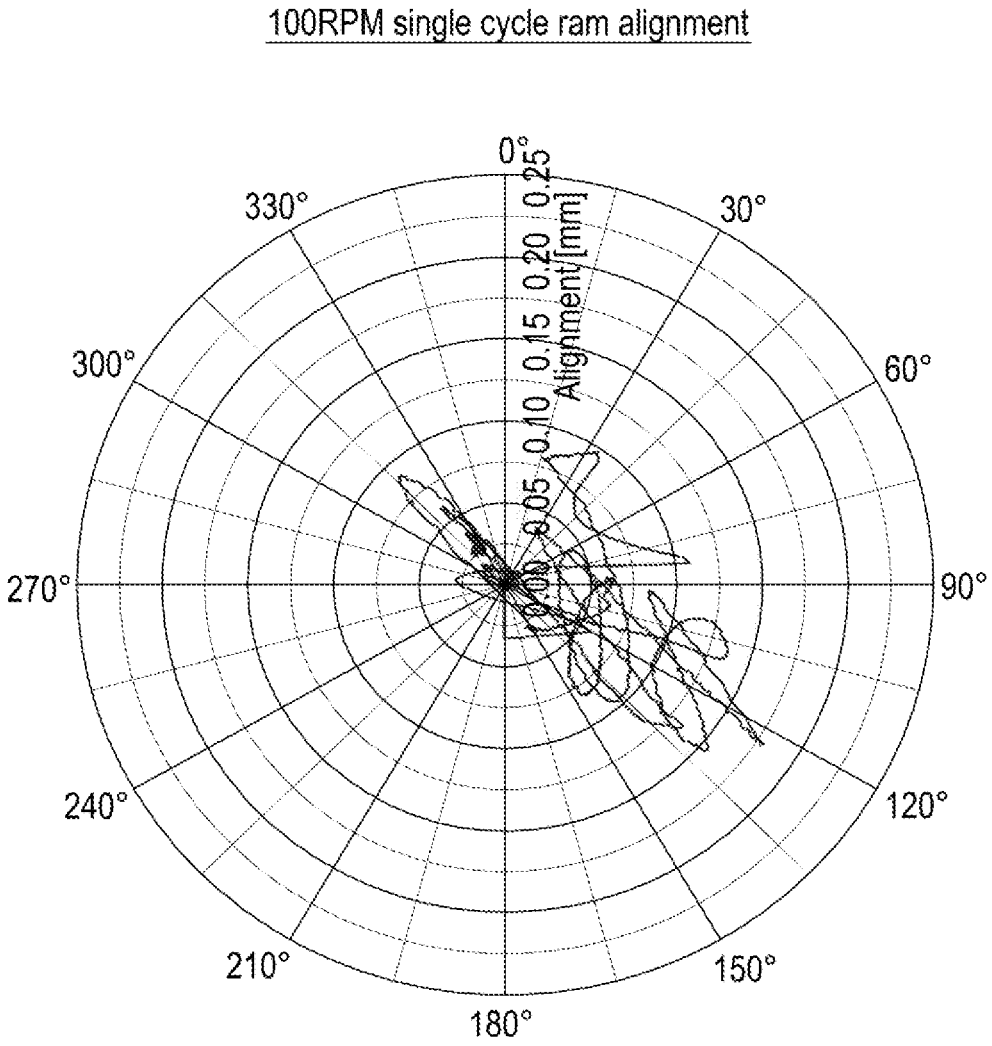
FIG. 12 is a graphical representation of sensor output.

FIG. 12 is a graphical representation of an exemplary signal output from the sensors 11 of any of the embodiments of FIGS. 2 to 11, showing the position of a ram operating at 100 cycles per minute (equivalent to the drive shaft operating at a speed of 100 rpm). The signal output is recorded over a single cycle of the ram i.e. one complete ram stroke. The graph indicates the real-time radial deviation of the ram from its target or fully aligned position in millimetres. A deviation of 0.00 mm indicates that the ram is fully aligned and in its target position.

The graph also illustrates any deviation of the ram from its target trajectory. A deviation of 0 degrees indicates that the trajectory of the ram is correct. Any deviation from the target trajectory may indicate that the ram is "drooping" as it moves towards the domer on its forward stroke.

Figure 13:
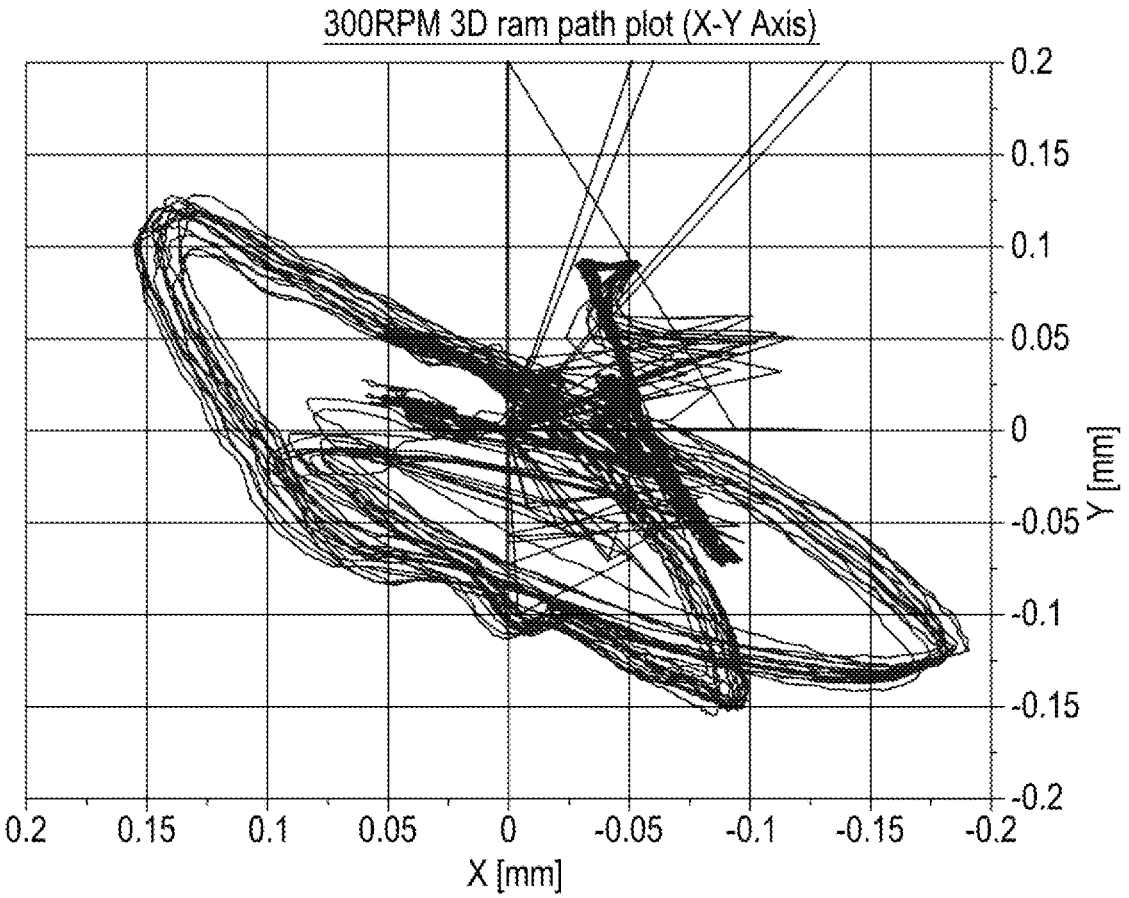
FIG. 13 is an alternative graphical representation of sensor output.

FIG. 13 is an alternative graphical representation of an exemplary signal output, showing the position of a ram operating at 300 rpm. The graph shows the position of the ram with respect to orthogonal X and Y axes, both transverse to the ram axis, as illustrated in FIGS. 2, 6, 7 and 9, as it passes through the central bore of the stripper housing 13, 113 or the sensor housing 213. The target position of the ram is 0,0. Deviation of the ram from this position may indicate that the ram is incorrectly aligned and requires adjustment. In this example, the measurement of the ram position is recorded over multiple ram cycles.

Figure 14:
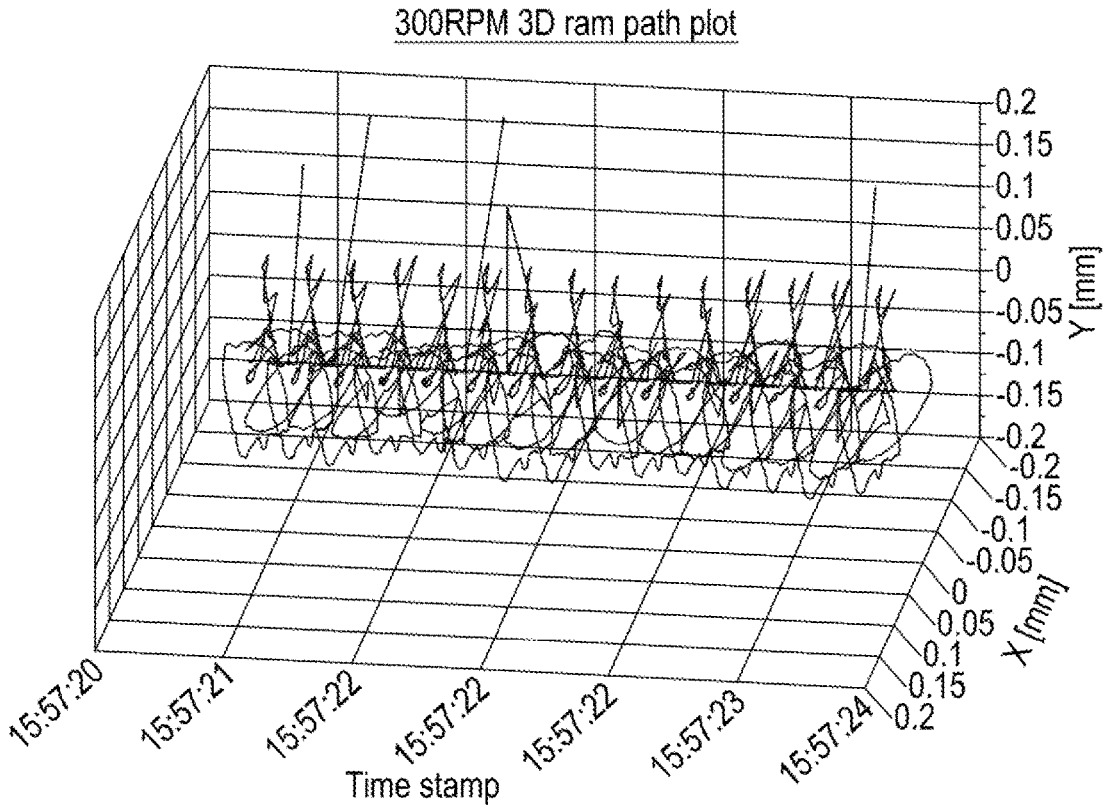
FIG. 14 is a further alternative graphical representation of sensor output.

FIG. 14 is a further alternative graphical representation of an exemplary signal output, showing the position of a ram operating at 300 rpm. This 3D graph illustrates the position of the ram with respect to the X and Y axes of the bodymaker 1, as illustrated in FIGS. 2, 6, 7 and 9, over time. The target position of the ram is 0,0, i.e. this is the position at which the ram is fully aligned as it passes through the internal bore of the stripper housing 13, 113 or the sensor housing 12.

It will be appreciated that for each of the exemplary outputs above, the signal data from the eddy current sensors is processed at the bodymaker controller prior to display on the HMI. This allows the data from the sensors to be presented in many different ways, depending on what is being measured. The data from the sensors may be presented in real-time to an operator in different formats simultaneously, allowing an operator to determine whether the ram/punch of the bodymaker is out of alignment or has an incorrect trajectory.

If the diagnostic output from the sensors 11 indicates that the ram is misaligned e.g. the ram is hitting the domer in an incorrect position, further action may be taken to re-align the ram/punch and/or other components of the bodymaker. For example, the bodymaker may be halted and an operator may manually adjust the domer position so that it aligns with the ram/punch. Alternatively, the ram/punch may be re-aligned. In a further embodiment (not shown here) realignment of the domer and/or of the ram/punch may be carried out automatically. In other words, the output from the sensors 11 may form part of a feedback system which automatically adjusts the position of the domer, for example, until the sensor 11 outputs indicate that the domer is aligned with the position of the ram and/or punch. In this way, the alignment between the ram/punch and other components of the bodymaker may be continuously adjusted as required during operation of the bodymaker.

An adjustment mechanism for automatically adjusting the domer, for example, might comprise a motorised worm drive, linked to the bodymaker controller, which adjusts the domer in a vertical and in a horizontal plane, so that it is aligned with the ram and/or the punch.

It will be understood by the person of skill in the art that various modifications may be made to the above described embodiments without departing from the scope of the present invention. For example, although in the examples above the bodymaker ram is described as moving in a horizontal direction through a series of annular dies, in other embodiments the bodymaker may be configured such that the ram moves vertically, or otherwise. It will also be appreciated that embodiments of the invention have application outside of the field of bodymakers. For example, the radial offset monitor may be used to monitor the alignment of a piston.

Figure 15A:
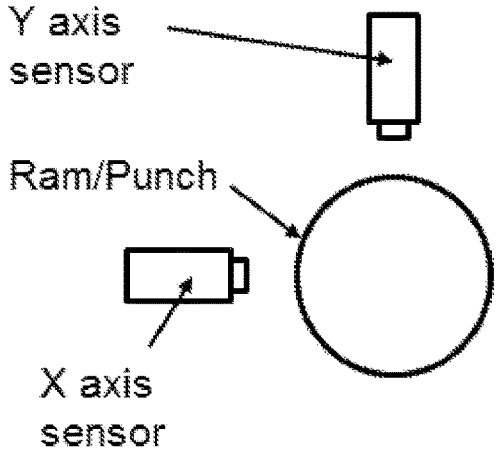
FIGS. 15*a* and 15*b* illustrate alternative sensor arrangements.
Figure 15B:
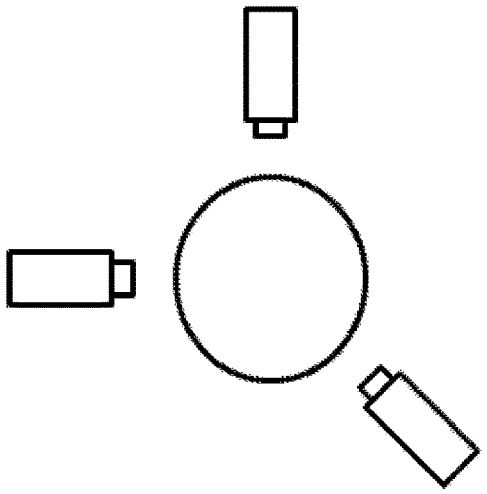

Although the embodiments of FIGS. 2 to 11 described above are provided with four eddy current sensors, equiangularly spaced around the stripper/sensor housing, it will be appreciated that, for any of the above embodiments, fewer or additional sensors may be supplied. For example, FIG. 15*a* illustrates an arrangement in which two eddy current sensors are located in "X-axis" and "Y-axis" positions respectively i.e. spaced 90 degrees apart. Alternatively, as shown in FIG. 15*b*, three eddy current sensors may be provided, two located in "X-axis" and "Y-axis" positions i.e. spaced 90 degrees apart and a third located at a position 135 degrees from the other two.

The invention claimed is:

1. A stripper assembly for a can bodymaker and being configured to remove a can body from a punch mounted on a ram of the can bodymaker, the stripper assembly comprising:

a stripper housing defining an internal bore through which the punch passes; and a radial offset monitor comprising one or more eddy current sensors, the one or more eddy current sensors being located within the stripper housing and being capable of detecting the misalignment of a can body held on a punch moving axially through the bore while the bodymaker is in operation and can bodies are being fed in, relative to an axis of the can body.

2. The stripper assembly according to claim 1, wherein the radial offset monitor is integrated into the stripper housing.

3. The stripper assembly according to claim 1, comprising a sensor housing co-located with the stripper housing, wherein the sensor housing defines an internal bore and the one or more eddy current sensors are located within the sensor housing.

4. The stripper assembly according to claim 1, comprising a stripper provided with stripping fingers.

5. The stripper assembly according to claim 1, comprising at least two eddy current sensors angularly spaced apart from one another about an axis along which the punch travels.

6. The stripper assembly according to claim 5, wherein the radial offset monitor comprises four eddy current sensors equiangularly spaced apart from one another about said axis.

7. The stripper assembly according to claim 1, wherein each of the one or more eddy current sensors is adjustable in a direction orthogonal to an axis along which the punch travels.

8. The stripper assembly according to claim 1, wherein said bore is cylindrical.

9. A can bodymaker comprising:

a toolpack; and the stripper assembly according to claim 1.

10. The can bodymaker according to claim 9 and comprising a controller having:

an input for receiving sensor data from the radial offset monitor; and a processor configured to compute one or more of ram position, ram trajectory, punch position, punch trajectory, can body presence, and can body sidewall thickness.

11. The can bodymaker according to claim 9 and comprising a screw adjustment mechanism to automatically adjust one or more components of the bodymaker in response to detection by the radial offset monitor of a misalignment of the ram and/or punch and/or can body in order to achieve realignment.

12. The can bodymaker according to claim 11, wherein the one or more components is or include the ram, the punch, a domer, and the adjustment is a radial adjustment.

13. A can bodymaker comprising a radial offset monitor, said radial offset monitor comprising:

a stripper including a housing;

a body located in the stripper housing and defining an internal bore; and one or more eddy current sensors positioned within the body, spaced around the bore and capable of detecting the misalignment of a can body held on a punch moving axially through the bore while the bodymaker is in operation and can bodies are being fed in, relative to an axis of the can body.

14. A method of detecting axial misalignment of a ram and/or a punch, or of a can body held on the punch in a can bodymaker, the method comprising:

providing a stripper housing defining an internal bore through which the punch passes;

obtaining electrical output signals from one or more eddy current sensors within the stripper housing; and processing the signal(s) to detect any axial misalignment, whereby the steps of obtaining electrical output signals and processing the signal(s) occur while the punch moves axially through the internal bore while the bodymaker is in operation and can bodies are being fed in, relative to an axis of the can body.

15. The method according to claim 14 and comprising processing the sensor data to compute one or more of ram position, ram trajectory, punch position, punch trajectory, can body presence, can body sidewall thickness.

16. The method according to claim 14, and comprising using a screw adjustment mechanism to automatically adjust one or more components of the bodymaker in order to correct the misalignment.

17. The method according to claim 14, the method being carried out while the bodymaker is producing can bodies.

18. A stripper assembly for a can bodymaker and being configured to remove a can body from a punch mounted on a ram of the can bodymaker, the stripper assembly comprising:

a stripper housing defining an internal bore through which the punch passes; and a radial offset monitor comprising one or more eddy current sensors, the one or more eddy current sensors being located within the stripper housing or attached thereto, wherein the radial offset monitor is configured to detect misalignment of the ram and/or the punch, or of a can body held on the punch, within said bore while the punch moves axially through the internal bore while the bodymaker is in operation and can bodies are being fed in, relative to an axis of the can body.

* * * * *